US005871087A

United States Patent [19]

Su

[11] Patent Number: 5,871,087

[45] Date of Patent: Feb. 16, 1999

[54] COMMON CONDUCTOR ASSEMBLY FOR A CONTACT SWITCH

[75] Inventor: Su Su, Taipei Hsien, Taiwan

[73] Assignee: Shin Jiuh Corp., Hsin-Tein, Taiwan

[21] Appl. No.: 170,853

[22] Filed: Dec. 21, 1993

[51] Int. Cl.[6] ..... H01H 5/06

[52] U.S. Cl. ..... 200/462; 200/467

[58] Field of Search ..... 200/462, 467, 200/405, 463, 464

[56] References Cited

U.S. PATENT DOCUMENTS

| | | | |
|---|---|---|---|
| 3,078,105 | 7/1963 | Anderson et al. | 200/467 |
| 3,141,075 | 7/1964 | Brevick et al. | 200/467 |
| 4,673,778 | 6/1987 | Lewandowski et al. | 200/467 |

*Primary Examiner*—David J. Walczak
*Attorney, Agent, or Firm*—Sandler, Greenblum & Bernstein

[57] ABSTRACT

A common conductor assembly is employed in a contact switch and includes a mounting plate, a pivotally movable member and a tension spring. The mounting plate has an elongated flat portion with first and second vertical edges, and first and second end plate portions extending integrally and transversely from a respective one of the first and second vertical edges in a same direction. The first end plate portion has an outward face formed with an engaging groove that is perpendicular to the vertical edges of the elongated flat portion. The second end plate portion has a spring mounting neck formed thereat. A conducting leg plate portion extends downwardly and integrally from the second vertical edge of the elongated flat portion. The movable member has an engaging end received in the engaging groove of the first end plate portion, a central spring engaging hole formed therethrough, and an access slit extending from the engaging hole to one side of the movable member in the direction in which the first and second end plate portions extend. The slit has a width less than a diameter of the engaging hole. The tension spring has a looped end engaging the spring mounting neck and a hook end engaging the engaging hole via the slit so as to interconnect the movable member and the second end plate portion under tension.

1 Claim, 2 Drawing Sheets

COMMON CONDUCTOR ASSEMBLY FOR A CONTACT SWITCH

BACKGROUND OF THE INVENTION

1. Field of the Invention

This invention relates to a common conductor assembly, more particularly to a common conductor assembly for a contact switch.

2. Description of The Related Art

Referring to FIGS. 1 and 2, a conventional common conductor assembly is employed in a contact switch and includes a mounting plate 12, a pivotally movable member 13 and a tension spring 14. The contact switch includes a lower switch casing part 10, an upper switch casing part 11 connected to the lower switch casing part 10 to form a switch casing, a push button 15 and first and second conductors 16, 17. The mounting plate 12 is provided on the lower switch casing part 10 and has an elongated flat portion 120 with first and second vertical edges, and first and second end plate portions 125, 122 extending integrally and transversely from a respective one of the first and second vertical edges in a same direction. The first end plate portion 125 has an outward face formed with an engaging groove 126 that is perpendicular to the vertical edges of the elongated flat portion 120, and an upper edge formed with a notch 127. The second end plate portion 122 has a spring mounting hole 121 formed therethrough, and a distal end formed with a notch 124. A conducting leg plate portion 121 extends downwardly and integrally from the second vertical edge of the elongated flat portion 122 and through the lower switch casing part 10. The pivotally movable member 13 has an engaging end received in the engaging groove 126 of the first end plate portion 125, and a spring engaging hole 131 formed therethrough. The tension spring 14 has a first hook end and a second hook end. The first hook end of the tension spring 14 extends through the notch 127 of the first end plate portion 125 to engage the spring engaging hole 131, while the second hook end of the tension spring 14 extends through the notch 124 of the second end plate portion 122 to engage the spring mounting hole 123 so as to interconnect the movable member 13 and the mounting plate 12 under tension in order to permit movement of the movable member 13 between upper and lower positions when the push button 15 is pressed. Each of the first and second conductors 16, 17 has a downwardly extending leg portion which projects out of the lower switch casing part 10 in the same direction as the conducting leg portion 121 of the mounting plate 12. The first and second conductors 16, 17 have contact portions which are disposed inside the switch casing and which extend respectively above and below the movable member 13. The push button 15 is in contact with a portion of the tension spring 14, which portion is adjacent to the first hook end of the tension spring 14. The push button 15 is operable to actuate the tension spring 14 to move the movable member 13 between the upper position, wherein the movable member 13 is in contact with the first conductor 16, and the lower position, wherein the movable member 13 is in contact with the second conductor 17. The notch 124 of the second end plate portion 122 prevents the second hook end of the tension spring 14 from any vertical movement. The notch 127 of the first end plate portion 125 prevents the misplacement of the tension spring 14 in the first end plate portion 125 when the tension spring 14 is actuated.

The main drawback of the aforementioned conventional contact switch resides in the mounting of the tension spring 14. Since the spring mounting hole 121 of the second end plate portion 122 does not lie in the same orientation as that of the spring engaging hole 131 of the movable member 13, full automation of the mounting procedure of the tension spring 14 to interconnect the second end plate portion 122 and the movable member 13 is difficult, thereby resulting in waste of labor, a longer production time and a lower production rate. In addition, a manual mounting operation often results in poorer quality.

SUMMARY OF THE INVENTION

The main object of the present invention is to provide a common conducting unit for a contact switch which includes a spring mounting portion with a particular configuration that facilitates fully automated mounting of a tension spring.

According to this invention, a common conductor assembly for a contact switch includes a mounting plate, a pivotally movable member and a tension spring. The mounting plate has an elongated flat portion with first and second vertical edges, and first and second end plate portions that extend integrally and transversely from a respective one of the first and second vertical edges in a same direction. The first end plate portion that has an outward face formed with an engaging groove that is perpendicular to the vertical edges of the elongated flat portion. The second end plate portion has a spring mounting neck formed thereat. The mounting plate further has a conducting leg plate portion which extends downwardly and integrally from the second vertical edge of the elongated flat portion. The movable member has an engaging end received in the engaging groove of the first end plate portion, a central spring engaging hole formed therethrough, and an access slit extending from the engaging hole to one side of the movable member in the direction in which the first and second end plate portions extend. The slit has a width less than a diameter of the engaging hole. The tension spring has a looped end and a hook end. The looped end of the spring engages the spring mounting neck, while the hook end of the spring engages the engaging hole via the slit so as to interconnect the movable member and the second end plate portion under tension.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Since the present invention is related to the conventional common conducting unit of the contact switch described beforehand, only the characterizing parts will be detailed in the succeeding paragraphs.

Figure 1:
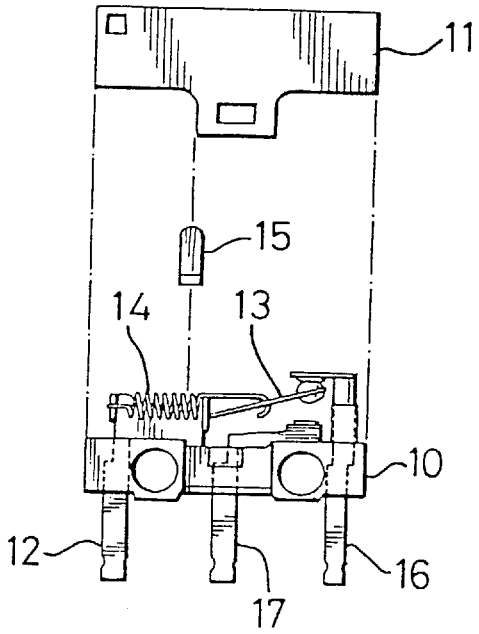
FIG. 1 PRIOR ART
FIG. 1 is a schematic view showing a contact switch which employs a conventional common conductor assembly.
Figure 2:
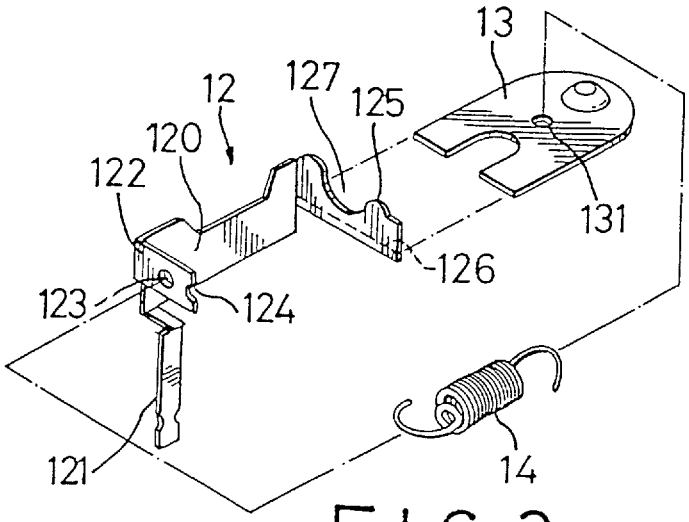
FIG. 2 PRIOR ART
FIG. 2 is an exploded view of the conventional common conductor assembly.
Figure 3:
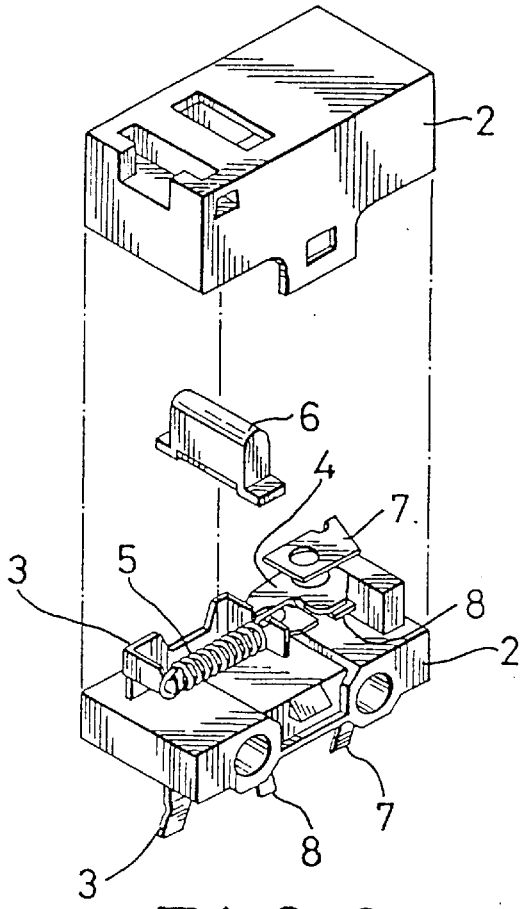
FIG. 3 is a schematic view showing a contact switch which employs a common conductor assembly according to the present invention.
Figure 4:
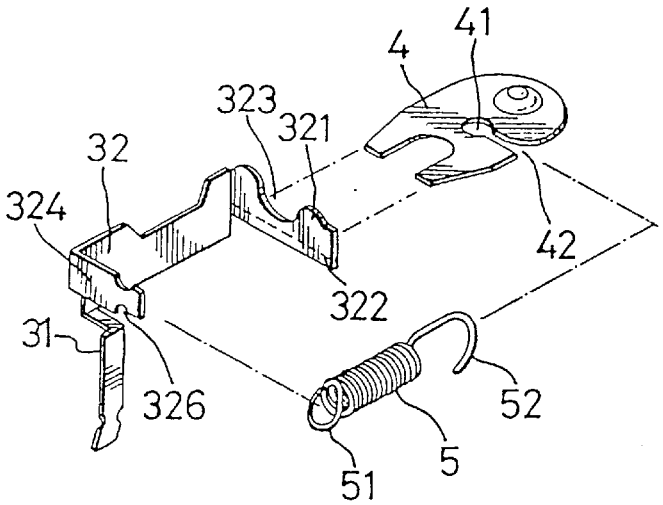
FIG. 4 is an exploded view of the common conductor assembly according to the present invention.

Referring to FIGS. 3 and 4, a common conductor assembly according to this invention includes a mounting plate 3, a pivotally movable member 4 and a tension spring 5. The common conductor assembly is employed in a contact switch which includes upper and lower switch casing parts 2, a push button 6 and first and second conductors 7, 8.

The mounting plate 3 has an elongated flat portion 32 with first and second vertical edges, and first and second end plate portions 321, 124 extending integrally and transversely from a respective one of the first and second vertical edges in a same direction. The first end plate portion 321 has an outward face formed with an engaging groove 322 that is perpendicular to the vertical edges of the elongated flat portion 32, and an upper edge formed with a notch 323. The second end plate portion 324 has a spring mounting neck 326 formed thereat. A conducting leg plate portion 31 extends downwardly and integrally from the second vertical edge of the elongated flat portion 32 and through the lower switch casing part 2.

The pivotally movable member 4 has an engaging end received in the engaging groove 122 of the first end plate portion 321, and a central spring engaging hole 41 formed therethrough. An access slit 42 extends from the engaging hole 41 to one side of the movable member 4 in the direction in which the first and second end plate portions 121, 124 extend. The slit 42 has a width that is less than a diameter of the engaging hole 41.

The tension spring 5 has a looped end 51 and a hook end 52. The looped end 51 of the tension spring 5 engages the spring mounting neck 326 and the hook end 52 of the tension spring 5 engages the engaging hole 41 via the access slit 42 so as to interconnect the movable member 4 and the mounting plate 1 under tension in order to permit movement of the movable member 3 between upper and lower positions when the tension spring 5 is actuated.

The common conductor assembly of the present invention is employed in a contact switch. The functions of the notch 323 of the first end plate portion 321, the movable member 4, the upper and lower switch casing parts 2, the push button 6, and the first and second conductors 7, 8 are the same as those of the previously described conventional contact switch and thus, a detailed description of such will be omitted herein.

Note that from the above illustration, the engaging hole 41 of the movable member 4 is accessible via the slit 42, and the slit 42 of the movable member 4 and the spring mounting neck 326 of the second end plate portion 124 are oriented in the same direction, thereby permitting easy mounting of the tension spring 5 so that full automation of the mounting process is facilitated. The feature and objective of the present invention is thus achieved.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A common conductor assembly for a contact switch comprising:

a mounting plate having an elongated flat portion with first and second vertical edges, and first and second end plate portions extending integrally and transversely from a respective one of said first and second vertical edges in a same direction, said first end plate portion having an outward face formed with an engaging groove that is perpendicular to said vertical edges of said elongated flat portion, said second end plate portion having a spring mounting neck formed thereat, said mounting plate further having a conducting leg plate portion which extends downwardly and integrally from said second vertical edge of said elongated flat portion;

a pivotally movable member having an engaging end received in said engaging groove of said first end plate portion, a central spring engaging hole formed therethrough, and an access slit extending from said engaging hole to one side of said movable member in the direction in which said first and second end plate portions extend, said slit having a width less than a diameter of said engaging hole; and a tension spring having a closed loop end and a hook end, said closed loop end of said spring engaging said spring mounting neck and said hook end of said spring engaging said engaging hole via said slit so as to interconnect said movable member and said second end plate portion under tension.

* * * * *